US011834801B2

(12) United States Patent
Ware

(10) Patent No.: US 11,834,801 B2
(45) Date of Patent: Dec. 5, 2023

(54) BUILDING STRUCTURE INSIDE AND ABOVE A SWIMMING POOL OR MAN-MADE LAGOON POOL

(71) Applicant: Adelinda Lynn Ware, McKinney, TX (US)

(72) Inventor: Adelinda Lynn Ware, McKinney, TX (US)

( * ) Notice: Subject to any disclaimer, the term of this patent is extended or adjusted under 35 U.S.C. 154(b) by 0 days.

(21) Appl. No.: 17/724,293

(22) Filed: Apr. 19, 2022

(65) Prior Publication Data

US 2022/0341115 A1 Oct. 27, 2022

Related U.S. Application Data

(60) Provisional application No. 63/178,143, filed on Apr. 22, 2021.

(51) Int. Cl.
*E02B 17/00* (2006.01)
*E04H 9/14* (2006.01)

(52) U.S. Cl.
CPC ..... *E02B 17/00* (2013.01); *E04H 9/145* (2013.01); *E02B 2017/0039* (2013.01); *E02B 2017/0056* (2013.01)

(58) Field of Classification Search
CPC .... E04B 1/3404; E04B 1/3412; E04B 1/3408; E02D 27/16; E02D 27/50; E02D 27/52; E02D 27/525; E04H 9/14; E04H 9/145; E02B 17/00; E02B 2017/0056
USPC ..... 52/169.9
See application file for complete search history.

(56) References Cited

U.S. PATENT DOCUMENTS 4,221,090 A * 9/1980 Pahl ..... E04B 1/0007 52/297
4,807,418 A * 2/1989 Ferguson ..... E04B 1/0007 52/169.4
5,647,693 A * 7/1997 Carlinsky ..... E02D 5/00 52/169.9
5,848,507 A * 12/1998 Bozich ..... E04H 1/1238 52/126.5
6,347,487 B1 * 2/2002 Davis ..... E04H 9/145 52/64
7,921,604 B2 * 4/2011 Lino ..... E04H 9/14 114/45

(Continued)

FOREIGN PATENT DOCUMENTS

AU 2013368902 A1 * 7/2015 ..... E03B 3/02
CN 108590240 A * 9/2018 ..... E04B 1/34352

(Continued)

OTHER PUBLICATIONS

Diamonds Thudufushi Beach and Water Villas, https://thudufushibeach.diamondsresorts.com May 2017. (Year: 2017).*

*Primary Examiner* — Frederick L Lagman

(57) ABSTRACT

The purpose of this invention is to provide a method of constructing a building structure inside and above a swimming pool or, man-made lagoon pool to produce the tropical, exotic resort experience of being surrounded by water in a building. This invention is new because of the use of the invention method of constructing over inside and above a pool or man-made lagoon/body of water pool, instead of an ocean, lake, or other natural body of water. The method of constructing in a pool is the innovation.

1 Claim, 2 Drawing Sheets

(56) References Cited

U.S. PATENT DOCUMENTS

2013/0061553 A1* 3/2013 Nagy ..... E04B 1/04
52/742.16

FOREIGN PATENT DOCUMENTS

| | | | | | |
|---|---|---|---|---|---|
| CN | 112726829 | A | * | 4/2021 | ..... E04B 1/343 |
| KR | 20100040077 | A | * | 4/2010 | ..... E04B 1/343 |
| KR | 101059100 | B1 | * | 8/2011 | ..... E04B 1/34352 |
| KR | 101253113 | B1 | * | 4/2013 | |
| KR | 20150057142 | A | * | 5/2015 | |

* cited by examiner

BUILDING STRUCTURE INSIDE AND ABOVE A SWIMMING POOL OR MAN-MADE LAGOON POOL

BACKGROUND OF THE INVENTION

Description of Problem(s) that this Invention Solves

Many people long for but do not have the time and money to travel to a resort overwater bungalow structure surrounded by water, commonly found on tropical islands, like the island of Tahiti. Sometimes the nearest location may be thousands of miles away

Description on how the Invention is an Improvement Over Existing Technology

Buildings over the water are currently only done in natural bodies of water like oceans. This invention is a business use method improvement because the buildings will be built over man-made bodies of water, comprising of but not limited to swimming pools and man-made lagoon pools.

Individual and Business Demographics that would Use this Invention

Anyone can use this invention, such as families, couples, individuals, and people of all ages.

BRIEF SUMMARY OF THE INVENTION

This invention covers a method of constructing a building above and inside of a swimming pool or man-made lagoon pool elevated with stilts or another vertical support material that is secured to the ground. It simulates the exotic tropical getaway ambiance of a far-away island convenient and affordable. It brings the fun and excitement of a remote tropical island that enables one to relax, rejuvenate and escape from life's tensions.

BRIEF DESCRIPTION OF SEVERAL VIEWS OF INVENTION DRAWINGS

Figure 1:
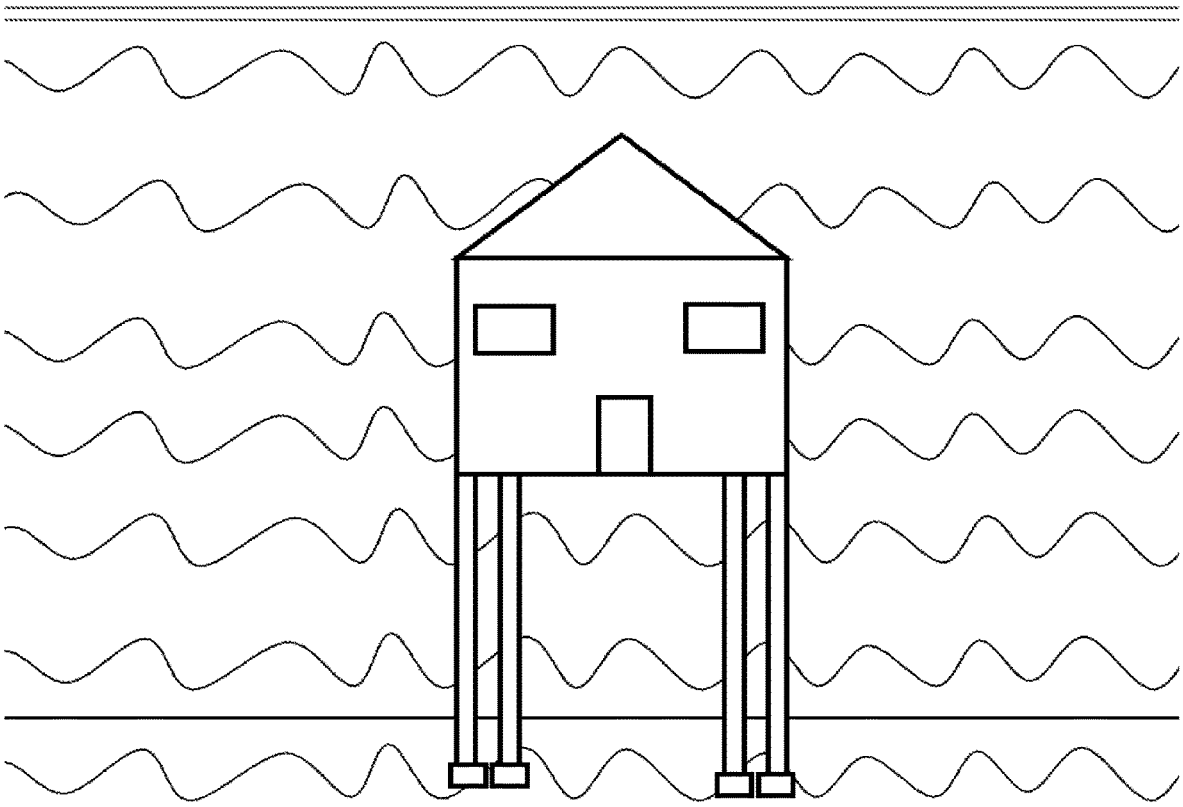

FIG. 1: This illustration is a close-up of a bungalow/building that's elevated above and inside the pool using stilts.

Figure 2:
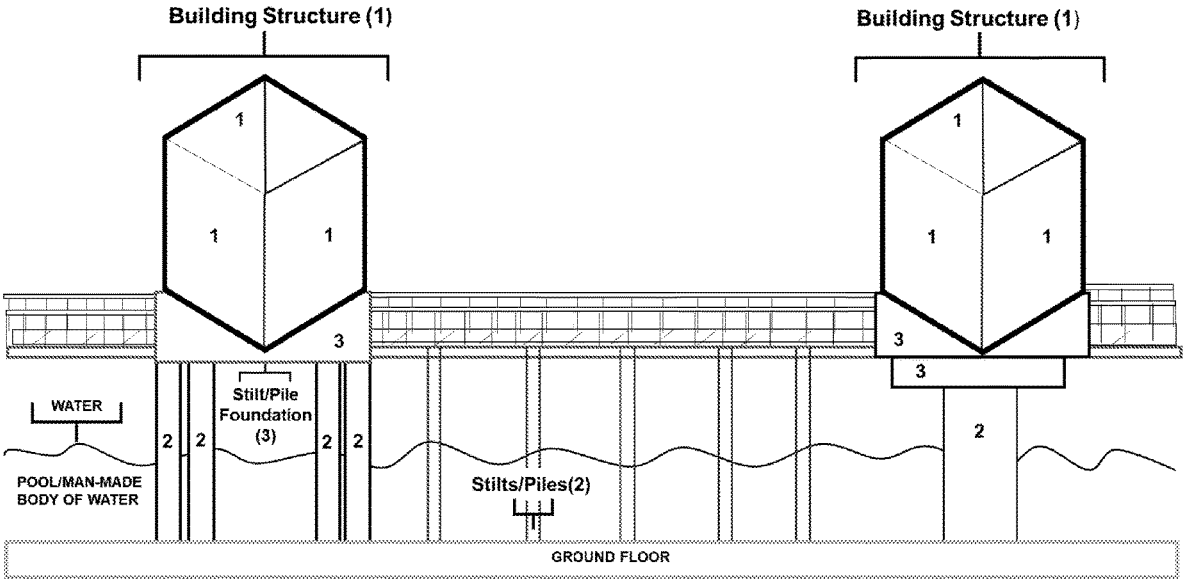

FIG. 2: These are illustrative examples of building structures with the parts named.

| REFERENCE NUMERAL | PART NAME |
|---|---|
| 1 | Building structure |
| 2 | Stilt/Pile(s) |
| 3 | Stilt Foundation |

DETAILED DESCRIPTION OF INVENTION

Description of the Parts of the Invention

| PART NUMBER | PART DESCRIPTION |
|---|---|
| Building (1) | A structure with a roof, floor, and walls, such as a house, room, school, store, restaurant, factory, etc. |
| Stilt/Pile (2) | The columns, poles, posts or pillars to elevate a structure a distance above the ground. Stilts or piles can be made of any strong material, such as concrete, wood, steel, etc. |
| Stilt/Pile Foundation (3) | The foundation of a structure that uses stilts or piles, usually reinforced by concrete or another strong material, to transfer the load of a structure deep into the ground. |

Relationship Between the Parts of the Invention

The stilts/piles connect to the stilt/pile foundation which bears the weight of the building structure

Details of the Invention Operation/Functions

The building structure holds people and objects
The stilt/pile foundation securely holds the weight of structures using stilts or piles
The stilt/pile goes deep into the ground to elevate the stilt/pile foundations that hold the structures, objects and people above the water to keep them dry and safe

Unique Features of Invention

The unique feature of this invention is the method of constructing. Buildings are current not constructed inside and above pools or man-made lagoon pools. They are built over natural bodies of water, such as oceans and lakes. The method of constructing building inside and above a pool, or man-made lagoon pool, enables more people in more locations to access the use of building structures over the water, since natural bodies of water are in limited locations.

Best Manufacturing Method

The most efficient way to produce this invention is to secure any number of stilts/piles deep in the ground using cement or another strong material and a stilt/pile foundation to hold and elevate the weight of the building structure above the water.

The invention claimed is:

1. A method of constructing a building inside and above a swimming pool or man-made lagoon pool comprising:
excavating land and removing dirt and debris;
installing and driving stilts/piles into a ground and securing;
constructing a pool with the stilts/piles inside the pool;
constructing and attaching a stilt/pile foundation to the stilts/piles;
constructing a building above the stilt/pile foundation;
and filling the pool with water.

* * * * *